United States Patent [19]

Matsumoto et al.

[11] Patent Number: 4,578,975

[45] Date of Patent: Apr. 1, 1986

[54] METHOD OF FORGING CRANK SHAFT

[75] Inventors: Kou Matsumoto, Kokubunji; Toshio Oota, Kawagoe; Yuji Asaka, Sayama; Mitsuki Nakamura, Niiza, all of Japan

[73] Assignee: Honda Giken Kogyo Kabushiki Kaisha, Tokyo, Japan

[21] Appl. No.: 634,521

[22] Filed: Jul. 26, 1984

[30] Foreign Application Priority Data

Jul. 26, 1983 [JP] Japan ..... 58-136283

[51] Int. Cl.[4] ..... B21D 22/00

[52] U.S. Cl. ..... 72/356; 29/6

[58] Field of Search ..... 72/356, 352, 360, 353; 29/6

[56] References Cited

U.S. PATENT DOCUMENTS

| | | | |
|---|---|---|---|
| 3,266,118 | 8/1966 | Drew | 29/6 |
| 3,590,469 | 7/1971 | Rohs | 29/6 |
| 4,041,755 | 8/1977 | Rut | 72/356 |
| 4,094,048 | 6/1978 | Broden | 29/6 |
| 4,317,355 | 3/1982 | Matsuno | 72/342 |
| 4,438,644 | 3/1984 | Rut | 72/353 |

*Primary Examiner*—Leon Gilden

*Attorney, Agent, or Firm*—Armstrong, Nikaido, Marmelstein & Kubovcik

[57] ABSTRACT

A method of forging a crank shaft at least including: a first step of forming a pair of fitting grooves in an outer periphery of a crank throw portion, said grooves extending perpendicular to an axis of the crank throw portion as well as to a diametral line thereof; a second step of subjecting said billet to rough forging by using a rough forging mold adapted to determine the position of the billet in cooperation with the fitting grooves of the crank throw portion and a journal portion, in which step, an outflow of burr is restricted by means of an inclined offset surface disposed opposite to the outflow direction of said burr while the crank throw portion is forced to move towards a crank pin position; and a third step of subjecting said billet to finish forging by using a finish forging mold, wherein burr is restricted its outflowing by an inclined offset surface disposed opposite to the outflow direction of the burr.

5 Claims, 23 Drawing Figures

1
2
3
4
5
J1
J2
J3
C1
C2

METHOD OF FORGING CRANK SHAFT

BACKGROUND OF THE INVENTION

1. Field of the Invention

The present invention relates to a method of forging a crank shaft for molding an integral type crank shaft for an internal combustion engine by forging, under the heating state, a billet which is distributed in capacity into a crank throw portion corresponding to a crank pin and balance weights on both sides thereof and into a journal portion. The invention also relates to a rough forging mold and a finish forging mold used for the forging method.

2. Description of the Prior Art

In the past, it has been general that in forging and molding a crank shaft, a billet consisting of a round bar or a billet which is so shaped as to have a distribution in capacity into a crank throw portion having a large diameter and a journal portion having a small diameter is forged and molded by rough forging and finish forging, after which deflashing is effected.

In a conventional forging and molding as above, in case of a billet consisting of a round bar, the positioning of a billet 40 to a crank pin forming recess 38 and a balance weight forming recess 39 of a lower mold 37 and the positioning of billet 40 to a journal forming recess 41 are uncertain as shown in FIGS. 1 and 2. This is true of a billet which is shaped with a distribution in capacity into a crank throw portion and a journal portion. Also, in the prior art, as shown in FIG. 3, projections 43, 44 are provided on peripheral edges of recesses 38, 39 and 41 of an upper mold 42 and a lower mold 37, and a gap 45 between the projections 43, 44 is made small in order to restrict an outflow of burr 4. However, the gap 45 is formed to be further widened and open outwardly in a horizontal direction so that the effect of restricting the outflow of the burr 4 could hardly been expected.

As described above, the positioning has been uncertain and the outflow of burr great in the prior art. Therefore, the weight of billet has inevitably become heavy and thus the yield has been deteriorated, uneconomically increasing heating energy required and necessitating a large apparatus of high forging pressure.

SUMMARY OF THE INVENTION

The present invention has been proposed for overcoming the drawbacks noted above. It is a first object of the present invention to provide an economical method for forging a crank shaft, whereby a billet can easily and positively be positioned relative to a mold and an outflow of burr can be restricted.

A forging method in accordance with a first aspect of the invention to achieve the above-described first object at least includes: a first step of forming a pair of fitting grooves in an outer periphery of the crank throw portion of the billet at an axially central portion thereof, said grooves extending perpendicular to an axis of the crank throw portion as well as to a diametral line thereof; a second step of subjecting said billet to rough forging by using a rough forging mold which comprises upper and lower molds having respective recesses which are adapted to determine the position of said billet incooperation with said fitting grooves of the crank throw portion and the journal portion of the billet, in which step, an outflow of burr is restricted by means of an inclined offset surface disposed opposite to the outflow direction of said burr while the crank throw portion is forced to move towards a crank pin position; and a third step of subjecting said billet to finish forging by using a finish forging mold which comprises upper and lower molds having respective recesses formed corresponding to a target shape of a crank shaft, wherein burr is restricted its outflowing by an inclined offset surface disposed opposite to the outflow direction of said burr.

In accordance with the above-described first aspect of the invention, the prepared amount of a billet is lessened in weight, as a consequence of which the yield is enhanced and heating energy is reduced. Furthermore, the moldability is enhanced, the forging pressure can be lowered and accordingly, a small forging apparatus can be used.

It is a second object of the present invention to provide a rough forging mold which is used for the aforementioned economical method of forging a crank shaft, this mold being advantageous in easily and positively positioning a billet, and adapted to restrict the outflow of burr.

A rough forging mold is provided in accordance with the second aspect of the invention to achieve the second object, in which upper and lower molds each have a crank pin forming recess, balance weight forming recesses on both sides thereof, and a journal forming recess, there are provided with raised portions between both the balance weight forming recesses of the upper and lower molds, these raised portions being formed inclined to define, when they are opposed to each other, a cavity which gradually enlarges towards the crank pin forming recess and being shaped to be fittable with said fitting grooves, and mutually opposed surfaces of the upper and lower molds are each formed with a first flat surface which extends substantially horizontally outwardly from an end edge of each of said recesses, an inclined offset surface inclined in either upper or lower direction outwardly from said flat surface, and a second flat surface which extends substantially horizontally outwardly from the inclined offset surface.

In accordance with the second aspect, the upper and lower molds of the rough forging mold have the inclined raised portions between both balance weight forming recesses, which are adapted, when they are opposed to each other, to form a cavity which gradually enlarges towards the crank pin forming recess. Therefore, the crank throw portion of the billet is positively forced to move toward the crank pin position, and the fitting grooves of the billet are fitted to the raised portions so that axial positioning of the billet can be achieved positively and easily. Moreover, since inclined offset surfaces are disposed opposite to a direction of outflow of burr, the outflow of burr is restricted to improve the yield, the moldability is enhanced, forging pressure can be reduced and the heating amount can be reduced.

It is a third object of the present invention to provide a finish forging mold which is used for the above-described method of forging a crank shaft and which can restrict the outflow of burr.

There is provided a finish forging mold in accordance with the third aspect of the invention, wherein opposed surfaces of the upper and lower molds are spaced from each other and are each formed with a first flat surface which extends substantially horizontally outwardly from an end edge of a recess, an inclined offset surface inclined in either upper or lower direction outwardly from said flat surface, and a second flat surface which extends substantially horizontally outwardly from the inclined offset surface.

In accordance with this third aspect, the burr flowing out of the cavity impinges upon either one of the inclined offset surfaces to change its flowing direction whereby the outflow of burr is momentarily controlled, during a period of which the cavity is filled with a material, thus enhancing the moldability. As the result, the yield is improved, the mold can be miniaturized, handling of the material is facilitated, the amount of heat is reduced and the forging pressure can be lowered, realizing an economical forging and molding.

The above and other objects, features and advantages of the present invention will become apparent from the following description of preferred embodiments shown in the accompanying drawings.

BRIEF DESCRIPTION OF THE DRAWINGS

FIGS. 1–3 show the prior art, wherein FIG. 1 is a sectional view showing positioning of a billet consisting of a round bar to a crank throw portion, FIG. 2 is a sectional view showing positioning of a billet to a journal portion, and FIG. 3 is a sectional view showing the outflowing state of burr;

FIG. 5 is a longitudinal sectional view of a rough forging mold, FIG. 6 is a plan view taken on line VI—VI of FIG. 5, FIG. 7 is a sectional view taken on line VII—VII of FIG. 6, FIG. 8 is an enlarged sectional view of a portion VIII of FIG. 5, FIG. 9 is a longitudinal sectional view of a finish forging mold, and FIGS. 10–13 are sectional views showing the states for resepctive steps of forging, in each of which (a) shows a portion corresponding to that taken on line A—A of FIG. 5, and (b) shows a portion corresponding to that taken on line B—B of FIG. 5;

FIGS. 14 and 15 show another embodiment of the present invention, wherein FIG. 14 is a perspective view of a billet and FIG. 15 is a view as corresponding to FIG. 10(*b*)

DESCRIPTION OF THE PREFERRED EMBODIMENTS

Some embodiments of the present invention will be described hereinafter with reference to the drawings.

Figure 1:
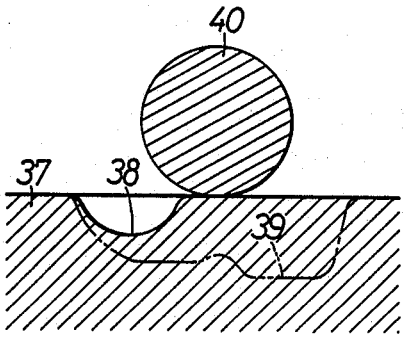
FIG. 1 PRIOR ART
Figure 2:
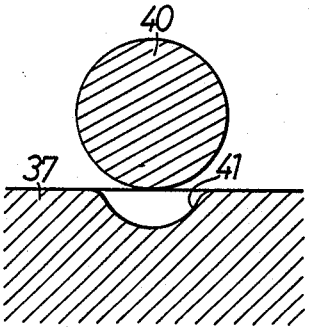
FIG. 2 PRIOR ART
Figure 3:
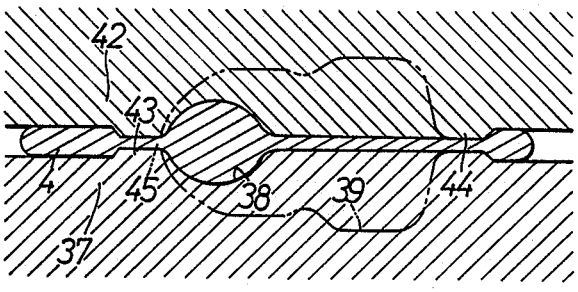
FIG. 3 PRIOR ART
Figures 4A, 4B, 4C, 4D:
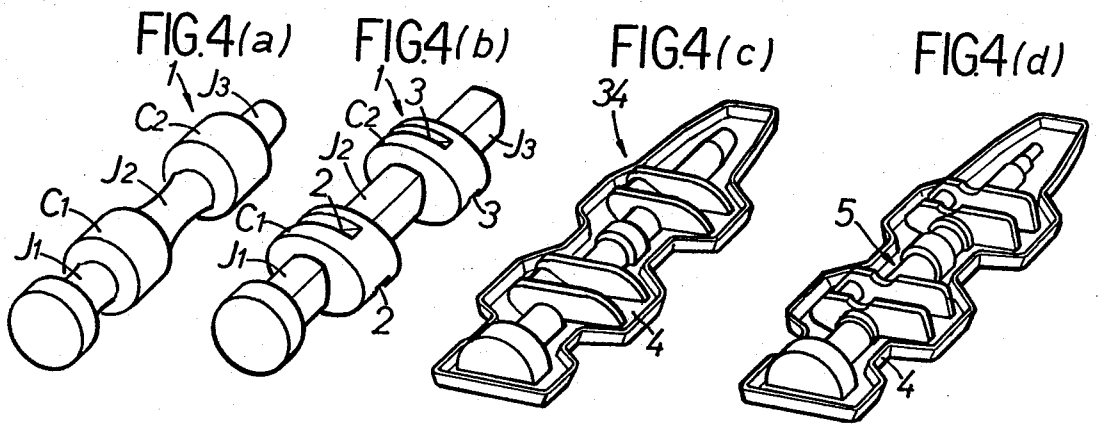
FIGS. 4–13 show one embodiment of the present invention, wherein FIGS. 4(*a*), (*b*), (*c*), and (*d*) are perspective views showing the shapes of a billet in respective steps of forging.

FIGS. 4–13 show a first embodiment. Referring first to FIG. 4, a billet 1 is distributed in its capacity into two crank throw portions C1, C2 and three journal portions J1, J2 and J3 as shown in FIG. 4(*a*). This billet is then formed at the crank throw portions C1, C2 with respective pairs of fitting grooves 2, 3 as shown in FIG. 4(*b*). Next, the billet 1 is formed into a semi-forged product of a rough shape as shown in FIG. 4(*c*) by rough forging, and thereafter finished as shown in FIG. 4(*d*) by finish forging. Burr 4 is removed from the billet thereby to form a crank shaft 5 for a 2-cylinder internal combustion engine.

Figure 5:
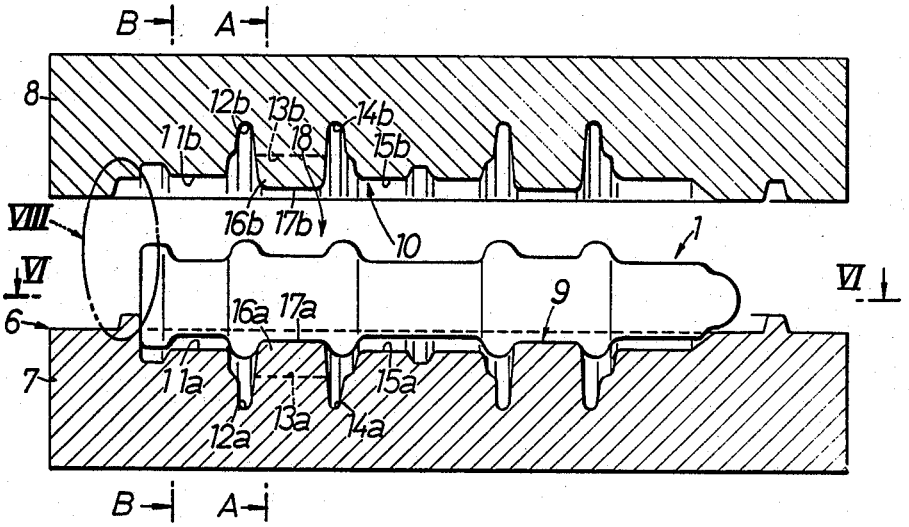
Figure 6:
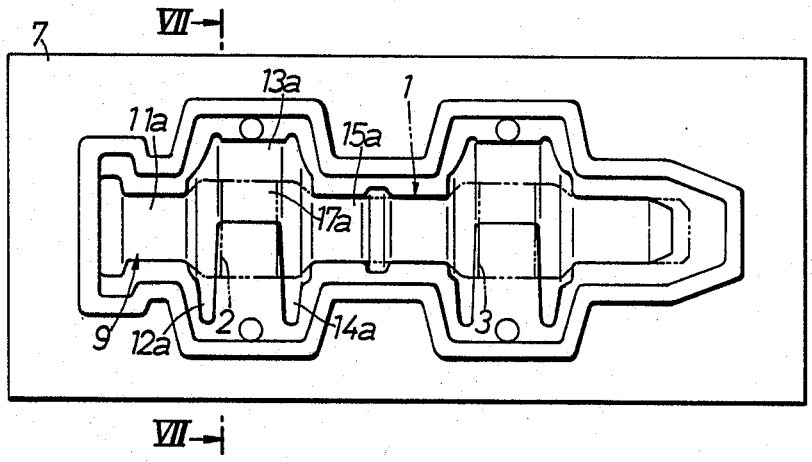

In FIGS. 5 and 6, a rough forging mold 6 comprises a lower mold 7 and an upper mold 8, and an upper surface of the lower mold 7 and a lower surface of the upper mold 8 are respectively formed with recesses 9, 10 for forming a billet corresponding to a rough shape of a crank shaft. The recess 9 on the lower mold 7 consists of two cylinder portions continuously formed with each other, each of the cylinder portions comprising a first journal forming recess 11*a*, a first balance weight forming recess 12*a* concentric with said recess 11*a*, a crank pin forming recess 13*a* eccentric with respect to the first journal forming recess 11*a*, a second balance weight forming recess 14*a* concentric with the first balance weight forming recess 12*a*, and a second journal forming recess 15*a*, which mutually communicate with one another.

Figure 7:
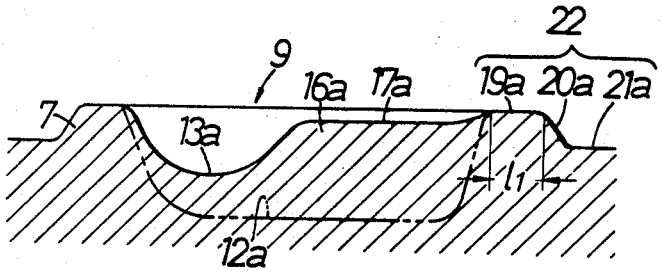

In FIG. 7, a raised portion 16*a* is formed between the first and second balance weight forming recesses 12*a* and 14*a*, and a top 17*a* of the raised portion 16*a* is formed flat while being downwardly inclined towards the pin forming recess 13*a*.

The recess 10 on the upper mold 8 is formed correspondingly to the recess 9 on the lower mold 7 and its portions are indicated by numbers with a suffix 'b' attached to the numbers indicating the corresponding portions of the recess 9 in place of the suffix 'a'. Accordingly, when the lower mold 7 is made to oppose to the upper mold 8, raised portions 16*a*, 16*b* define a caivty 18 which enlarges towards the crank pin forming recesses 13*a*, 13*b*.

Turning again to FIG. 4(*a*), the billet 1 is obtained by forging and molding while rotating a round bar or by roll molding. The billet 1 has its capacity distributed in correspondence to recesses 9, 10, that is, into two crank throw portions C1, C2 corresponding to first balance weight forming recesses 12*a*, 12*b*, crank pin forming recesses 13*a*, 13*b* and second balance weight forming recesses 14*a*, 14*b*; and three journal portions J1, J2 and J3 corresponding to journal forming recesses 11*a*, 11*b* and 15*a*, 15*b*. That is, the crank throw portions C1, C2 are formed to have relatively large capacities and have their cross-section generally formed into a circle, while the journal portions J1, J2 and J3 are formed to have relatively small capacities.

In accordance with the present invention, on the outer periphery of the crank throw portions C1, C2, respective pairs of fitting grooves 2, 3 are bored to extend perpendicularly to axes of the crank throw portions C1, C2 as well as to a diametral line thereof at an axially central position as shown in FIG. 4(*b*) so as to be located on both ends of said diametral line. These fitting grooves 2, 3 can be fitted into the raised portions 17*a*, 17*b* of the lower and upper molds 7, 8.

The journal portions J1, J2 and J3 have their cross-sections formed into an elliptical shape, of which long diameter is an imaginary straight line parallel to the aforesaid diametral line of the crank throw portions C1, C2, that is, a diametral line connecting between both the fitting grooves 2, 3.

Figure 8:
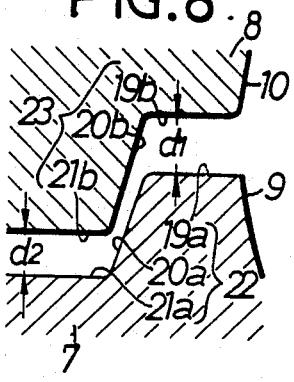

In FIG. 8, an opposing surface 22 of the lower mold 7 to the upper mold 8 consists of a first flat surface 19*a* extending substantially in a horizontal direction from an end edge of the recess 9, an inclined offset surface 20*a* inclined downwardly outwardly from the first flat surface 19*a*, and a second flat surface 21*a* extending substantially in a horizontal direction toward outside from the lower end of the inclined offset surface 20*a*. An angle of inclination between the inclined offset surface 20*a* and both the flat surfaces 19*a*, 21*a* is set to an angle close to a right angle.

An opposing surface 23 of the upper mold 8 is formed correspondingly to the opposing surface 22 of the lower mold 7. That is, the opposing surface 23 consists of a first flat surface 19*b* extending substantially in a horizontal direction outwardly from an end edge of the recess 10, an inclined offset surface 20*b* inclined downwardly outwardly from the first flat surface 19*b*, that is, towards the lower mold 7, and a second flat surface 21*b* extending substantially in a horizontal direction outwardly from the lower end of the inclined offset surface 20*b*.

A stopper, not shown, is provided on one of the opposing surfaces 22, 23 to maintain a spacing between both the opposing surfaces 22, 23 at a set value when the upper mold 8 is pressed towards the lower mold 7. The angles of inclination of the inclined offset surfaces 20*a*, 20*b* are set such that when the spacing between both the opposing surfaces 22, 23 assumes the set value, the spacing therebetween gradually narrows towards the lower side. A spacing d1 between the first flat surfaces 19*a*, 19*b* and a spacing d2 between the second flat surfaces 21*a*, 21*b* are set so that the ratio d1/d2 is approximately 1/0.8, for example, when both the opposing surfaces 22, 23 come closest to each other through the stopper.

Figure 9:
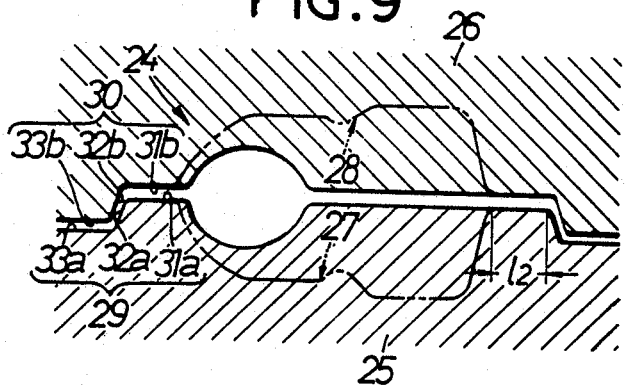

FIG. 9 is a sectional view showing a finish forging mold. This finish forging mold 24 comprises a lower mold 25 and an upper mold 26, and an upper surface of the lower mold 25 and a lower surface of the upper mold 26 are respectively formed with recesses 27, 28 corresponding to a finish shape of a crank shaft. Opposing surfaces 29, 30 of the molds 25, 26 are respectively formed with first flat surfaces 31*a*, 31*b*, inclined offset surfaces 32*a*, 32*b* and second flat surfaces 33*a*, 33*b*, likewise the aforementioned rough forging mold 6. However, the outwardly extended distance l2 of the first flat surfaces 31*a*, 31*b* is greater than that l1 of the rough forging mold 6 (l2>l1).

Next, operation of the embodiment will be described in order of steps with reference to FIG. 4 and FIGS. 10–13. The billet 1 shown in FIG. 4(*a*) is obtained by forging and molding while rotating a round bar or by roll molding. The billet 1 is bored with the fitting grooves 2, 3 as shown in FIG. 4(*b*), and the journal portions J1–J3 are formed to have an elliptical cross-section.

Figure 10A:
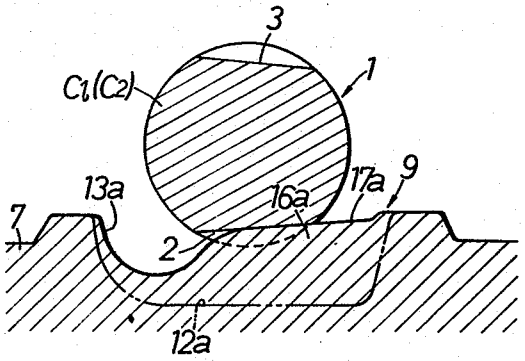
Figure 10B:
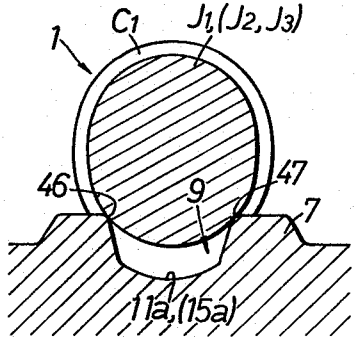

Next, the billet 1 is placed on the recess 9 of the lower mold 7 of the rough forging mold 6. At this time, the fitting grooves 2, 3 are fitted in the raised portion 16*a* of the recess 9, and the bottom of the fitting grooves 2, 3 is brought into abutment with the top 17*a* of the raised portion 16*a*, as shown in FIG. 10(*a*). The journal portions J1–J3 are fitted in the journal forming recesses 11*a*, 15*a* so as to come into contact with two upper edges thereof as shown in FIG. 10(*b*). In this manner, by fitting between the fitting grooves 2, 3 and the raised portion 16*a*, axial positioning in the recess 9 of the billet 1 is provided, and by fitting between the journal portions J1–J3 and the journal forming recesses 11*a*, 15*a*, horizontal positioning perpendicular to said axis in the recess 9 of the billet 1 is provided. Accordingly, positioning of the billet 1 to the recess 9 can be carried out accurately and very easily.

Figure 11A:
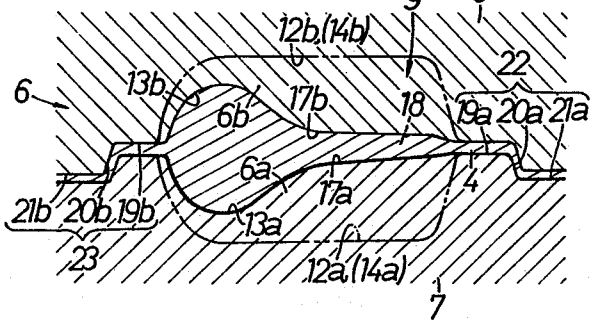
Figure 11B:
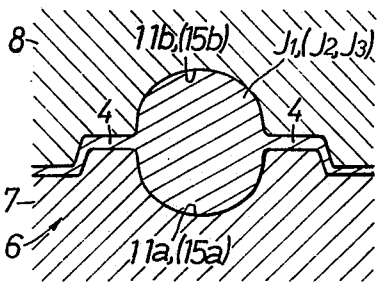

After positioning of the billet 1 to the recess 9 has been done, the upper mold 8 is moved down and pressed towards the lower mold 7 as shown in FIG. 11. At this time, the crank throw portions C1, C2 are pressed by both the molds 7, 8 in the cavity 18, as shown in FIG. 11(*a*), and are forced to come close to the crank pin forming recesses 13*a*, 13*b*. The journal portions J1–J3 are held and pressed by the journal forming recesses 11*a*, 15*a*; 11*b*, 15*b* to be formed into a substantial circle. Since the opposing surfaces 22, 23 of the molds 7, 8 comprise the first flat surfaces 19*a*, 19*b*, the inclined offset surfaces 20*a*, 20*b* and the second flat surfaces 21*a*, 21*b*, the inclined offset surface 20*b* is opposed to the outflow direction of the burr 4 to restrict the outflow of the burr 4.

Figure 12B:
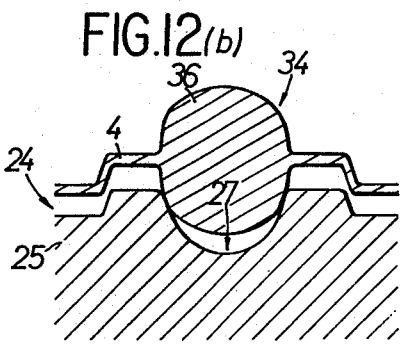
Figure 12A:
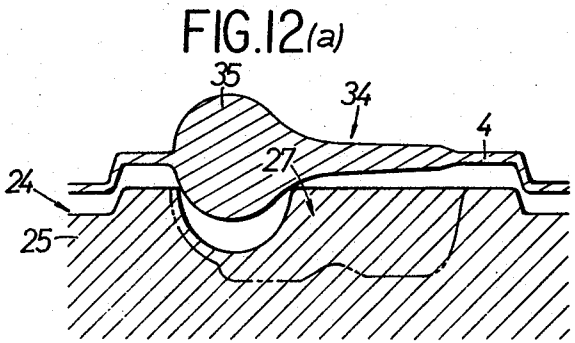

In this manner, the billet 1 is rough-forged by the rough forging mold 6 to form a crank shaft member 34 as shown in FIG. 4(*c*). Next, this crank sahft member 34 is placed on the lower mold 25 of the finish forging mold 24 as shown in FIGS. 12(*a*) and (*b*). At this time, the shape of the crank pin 35 and journal portion 36 has nearly been completed by rough forging, and therefore, positioning of the lower mold 25 to the recess 27 is easily accomplished.

Figure 13B:
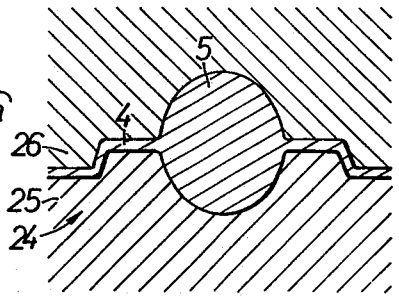
Figure 13A:
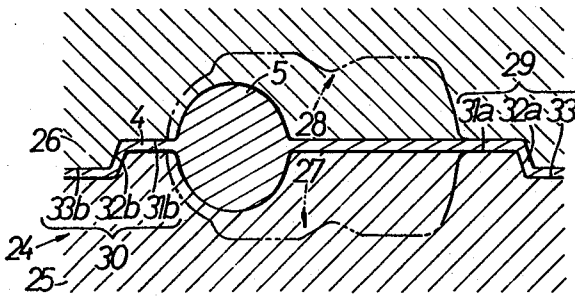

After the member 34 has been positioned in the recess 27 of the lower mold 25 as described above, the upper mold 26 is moved down and the crank shaft member 34 is pressed by the upper mold 26 and the lower mold 25, as shown in FIGS. 13(*a*) and (*b*). Since the recesses 27, 28 of both molds 25, 26 have been formed corresponding to the target shape, the crank shaft member 34 is forged and molded into a final target shape to form a crank shaft 5 as shown in FIG. 4(*d*). Also in the finish forging, the inclined offset surface 32*b* is opposed to the outflow direction of the burr 4, and therefore, the outflow of the burr 4 is restricted to the utmost.

Figure 14:
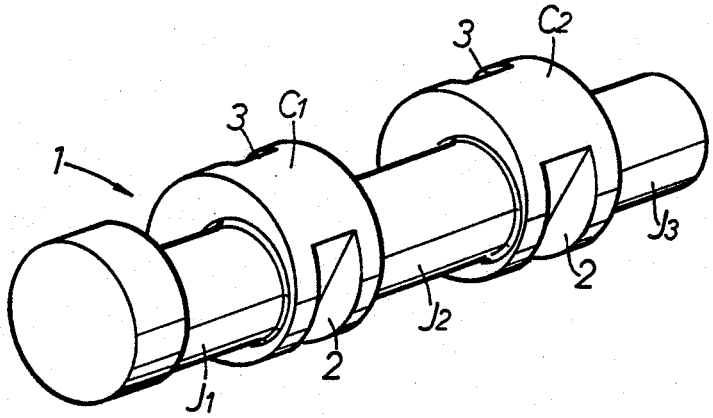
Figure 15:
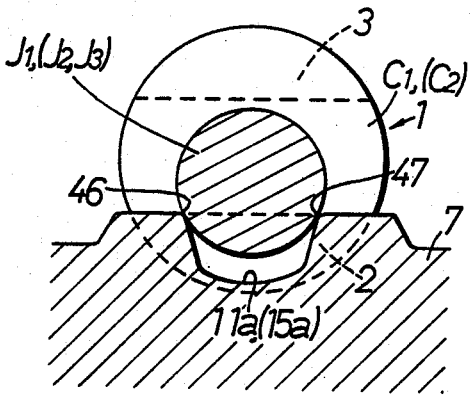
Figure 16:
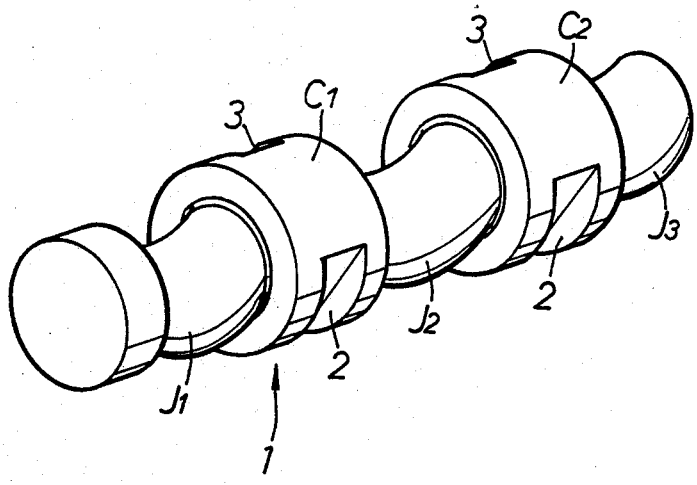
FIG. 16 is a perspective view of a billet according to a further embodiment of the invention.

FIGS. 14 and 15 show another embodiment of the present invention. Journal portions J1, J2 and J3 of the billet 1 are made eccentric with respect to either one of fitting grooves 2, 3, for example, with respect to the fitting groove 2, from the axis of crank throw portions C1, C2. With this, when a bottom of the fitting groove 2 is brought into contact with and fitted in a raised portion 16*a*, the outer peripheries of the journals J1–J3 can be placed in contact with upper edges 46, 47 of journal forming recesses 11*a*, 15*a* to achieve axial and lateral positionings.

As a further embodiment of the present invention, journal portions J1–J3 can be curved towards either one of the fitting grooves 2, 3, for example, towards the fitting groove 2. Even doing so, when the fitting groove 2 is fitted in a raised portion 16*a*, a part of the outer peripheries of the journal portions J1–J3 can be placed in contact with upper edges 46, 47 of journal forming recesses 11*a*, 15*a* to effect lateral positioning.

While in the above-described embodiments, the inclined offset surfaces 20*b*, 32*b* are inclined downwardly, it will be noted that they can be inclined upwardly, in which case, the inclined offset surfaces 20*a*, 32*a* of the lower molds 7, 25 are opposed to the outflow direction of the burr 4 to restrict the outflow thereof.

What is claimed is:

1. A method of forging a crank shaft for forging and molding, under the heating state, a billet which has its capacity distributed into a crank throw portion corresponding to a crank pin and balance weights on both sides thereof and into a journal portion, the method at least including: a first step of forming a pair of fitting grooves in an outer periphery of the crank throw portion of the billet at an axially central portion thereof, said grooves extending perpendicular to an axis of the crank throw portion as well as to a diametral line thereof; a second step of subjecting said billet to rough forging by using a rough forging mold which comprises upper and lower molds having respective recesses which are adapted to determine the position of said billet in cooperation with said fitting grooves of the crank throw portion and the journal portion of the billet, in which step, an outflow of burr is restricted by means of an inclined offset surface disposed opposite to the outflow direction of said burr while the crank throw portion is forced to move towards a crank pin position; and a third step of subjecting said billet to finish forging by using a finish forging mold which comprises upper and lower molds having respective recesses formed corresponding to a target shape of a crank shaft, wherein burr is restricted its outflowing by an inclined offset surface disposed opposite to the outflow direction of said burr.

2. A method of forging a crank shaft as defined in claim 1 wherein said upper and lower molds of the rough forging mold are provided with recesses opposed to each other, each of which at least includes a first journal forming recess, a first balance weight forming recess concentric with said first journal forming recess, a pin forming recess eccentric with respect to said first journal forming recess, a second balance weight forming recess concentric with the first balance weight forming recess, and a second journal forming recess concentric with the first journal forming recess, and wherein said billet to be processed by the first step has its capacity distributed into said crank throw portion corresponding to said pin forming recess and said first and second balance weight forming recesses and into said journal portion corresponding to the journal forming recesses, said pair of fitting grooves for fitting engagement with flat projections formed on said upper and lower molds between the first and second balance weight forming recesses thereof are formed in the outer periphery of said crank throw portion at an axially central portion thereof, in such a manner that those grooves extend perpendicular to the axis of said crank throw portion and its one diametral line, said journal portion being formed such that when a bottom of one of said fitting grooves is in contact with said flat projection of the lower mold, the outer peripheral surface of the journal portion comes at least partially into contact with a pair of parallel upper edges of each of said first and second journal forming recesses of said lower mold.

3. A method of forging a crank shaft as defined in claim 2 wherein a cross-section of said journal portion is formed into a long elliptical shape with its longer diameter along said diametral line of the crank throw portion which connects both the fitting grooves.

4. A method of forging a crank shaft as defined in claim 2 wherein said journal portion is eccentric with respect to either one of said fitting grooves from the center of the crank throw portion.

5. A method of forging a crank shaft as defined in claim 2 wherein said journal portion is curved towards either one of said fitting grooves.

* * * * *